US008448856B2

(12) United States Patent
Ito

(10) Patent No.: US 8,448,856 B2
(45) Date of Patent: May 28, 2013

(54) MEDIUM PROCESSING APPARATUS

(75) Inventor: Kazuyoshi Ito, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 101 days.

(21) Appl. No.: 13/063,312

(22) PCT Filed: Jul. 5, 2010

(86) PCT No.: PCT/JP2010/061420
§ 371 (c)(1),
(2), (4) Date: Mar. 10, 2011

(87) PCT Pub. No.: WO2011/065049
PCT Pub. Date: Jun. 3, 2011

(65) Prior Publication Data

US 2012/0097700 A1 Apr. 26, 2012

(30) Foreign Application Priority Data

Nov. 30, 2009 (JP) ..... 2009-270933

(51) Int. Cl.
*G07F 19/00* (2006.01)
*G07F 7/08* (2006.01)

(52) U.S. Cl.
USPC ..... 235/381; 235/379; 902/14

(58) Field of Classification Search
USPC ..... 235/379, 381; 902/8–21, 35, 36
See application file for complete search history.

(56) References Cited

U.S. PATENT DOCUMENTS

| | | | | |
|---|---|---|---|---|
| 6,036,089 | A * | 3/2000 | Oguchi et al. | 235/379 |
| 6,516,998 | B2 * | 2/2003 | Calder et al. | 235/381 |
| 6,978,928 | B2 * | 12/2005 | Shibata et al. | 235/381 |
| 7,708,192 | B2 * | 5/2010 | Yokoi et al. | 235/379 |
| 8,123,121 | B2 * | 2/2012 | Thum et al. | 235/379 |
| 8,328,176 | B2 * | 12/2012 | Shimamura | 270/58.13 |
| 2008/0142583 | A1 | 6/2008 | Yokoi et al. | |
| 2012/0093555 | A1 * | 4/2012 | Obuchi | 399/405 |

FOREIGN PATENT DOCUMENTS

| | | | |
|---|---|---|---|
| JP | 04-164774 | A | 6/1992 |
| JP | 09-044723 | A | 2/1997 |
| JP | 09-221239 | A | 8/1997 |
| JP | 2002-329229 | A | 11/2002 |
| JP | 2006-134071 | A | 5/2006 |
| JP | 2008-129987 | A | 6/2008 |

* cited by examiner

*Primary Examiner* — Jamara Franklin
(74) *Attorney, Agent, or Firm* — Rabin & Berdo, P.C.

(57) ABSTRACT

A bill processing apparatus is provided that can reduce the frequency of occurrences of removal of a paper medium (dispensed bill) being forgotten. Processing a medium handover port where a paper medium is handed over, and a medium handover port mechanism provided at the medium handover port and successively raising and lowering the paper medium, fed out from inside the machine (the automated teller machine), inside the medium handover port. The medium handover port mechanism notifies a user of the position of the paper medium with a visible action by successively raising and lowering the paper medium inside the medium handover port.

8 Claims, 11 Drawing Sheets

(AT BOTTOM DEAD POINT)

(AT TOP DEAD POINT)

MEDIUM PROCESSING APPARATUS

TECHNICAL FIELD

The present invention relates to a medium processing apparatus for handing over a paper medium to a user.

BACKGROUND ART

Such types of medium processing apparatus include, for example, automated teller machines (referred to below as "ATMs") for depositing and dispensing bills (banknotes), serving as a paper medium, and installed in branches of financial institutions, convenience stores, gasoline stands, supermarkets and the like.

Among ATMs, there are some ATMs configured to, in a dispensing transaction, collect dispensing bills in a money depositing and dispensing port, this being a medium handover port, open a shutter of the money depositing and dispensing port, and also raise dispensing bills so as to externally expose the dispensing bills from the money depositing and dispensing port in order to facilitate removal of the dispensing bills by a user.

Such a bill raising means is, for example, configured as described in Patent Document 1 and Patent Document 2.

The bill raising means described in Patent Document 1 (Japanese Patent Application Laid-Open (JP-A) No. 9-221239) couples a bottom plate to a "slider" that is coupled to a timing belt and for moving along a vertical slider axis direction, a gripped state is adopted with a press plate pressed against dispensing bills by using a parallel link mechanism, and the dispensing bills are raised together with the bottom plate in this state by forward rotating the timing belt.

Whereas, in the bill raising means described in Patent Document 2 (JP-A No. 2002-329229), the dispensing bills are placed in a gripped state sandwiched from right and left by a pantograph mechanism, the dispensing bills are raised in this state by forward rotating a conveying belt.

However, sometimes dispensing bills adhere to the inside of the depositing and dispensing port in an ATM. When dispensing bills have adhered to the inside of the depositing and dispensing port (and in particular at the far side of the apparatus), a user is no longer able to smoothly remove the dispensing bills from the depositing and dispensing port.

Furthermore, in cases where a user is, for example, an elderly person, someone with impaired vision, or the like, sometimes the user cannot immediately ascertain the position of the dispensing bills.

For these reasons, sometimes a user cannot quickly remove the dispensing bills from the depositing and dispensing port.

When dispensing bills have not been removed from the depositing and dispensing port for a specific duration or longer, the AIM emits an alarm nose at the periphery of the depositing and dispensing port, prompting the user to remove the dispensing bills. However, in cases where a use is, for example, an elderly person, someone with impaired hearing, or the like, the user sometimes cannot hear the alarm sound or falters in their response.

As a result dispensing bills are left for a long duration inside the depositing and dispensing port.

When dispensing bills have not been removed from the depositing and dispensing port for a predetermined bill removal duration or longer, the ATM determines that the dispensing bills have been left behind, and forgotten dispensing bill processing is performed. In such cases, the ATM reverse rotates the belt (for example, the timing belt in Patent Document 1 or the conveying belt in Patent Document 2), lowering the dispensing bills. The ATM thereby houses the dispensing bills inside the depositing and dispensing port. When the dispensing bills have been housed within the depositing and dispensing port, the ATM shuts the shutter of the depositing and dispensing port, and conveys the dispensing bills from inside the depositing and dispensing port to a removal forgotten cassette within the machine, and stores the dispensing bills in the forgot cassette as forgotten bills.

DISCLOSURE OF THE INVENTION

Technical Problem

In a conventional medium processing apparatus, as described above, when the paper medium (dispensing bills in the examples described above) has not been removed from the medium handover port (the depositing and dispensing port in the above examples described above) for a specific duration or longer, an alarm sound is emitted, prompting removal of the paper medium (the dispensing bills) by a user.

However, in a conventional medium processing apparatus, in cases where the user is an elderly person, someone with impaired hearing or the like, there are relatively common occurrences of the user still not being aware even though an alarm sound is emitted, necessitating performing processing of the forgotten paper medium. Accordingly, an issue is a wish to reduce the frequency of occurrences of paper medium being forgotten.

The present invention is made to address the issue described above, and has an object of providing a bill processing apparatus that can reduce the frequency of occurrences of forgetting to remove a paper medium.

Solution to Problem

In order to achieve the above object, the present invention is a medium processing apparatus for performing handover of a paper medium to a user, the medium processing apparatus including: a medium handover port where the medium is handed over; and a medium handover port mechanism, provided at the medium handover port and successively raising and lowering the medium inside the medium handover port.

The medium handover port mechanism provided to the medium processing apparatus successively raises and lowers the paper medium inside the medium handover port. The medium processing apparatus can thereby notify the user of the position of the paper medium by a visible action, even if the use is, for example, an elderly person, someone with impaired hearing, or the like. Consequently, the medium processing apparatus can reduce the frequency of occurrences of forgetting to remove the paper medium.

Note that the medium processing apparatus preferably also emits an alarm sound, and can thereby ensure that the user is notified of the position of the paper medium. Consequently, the frequency of occurrences of forgetting to remove the paper medium can be further reduced.

Advantageous Effects of the Invention

According to the present invention, a bill processing apparatus can be provided that can reduce the frequency of occurrences of forgetting to remove a paper medium (such as, for example, bills).

BEST MODE FOR IMPLEMENTING THE INVENTION

Figure 1:
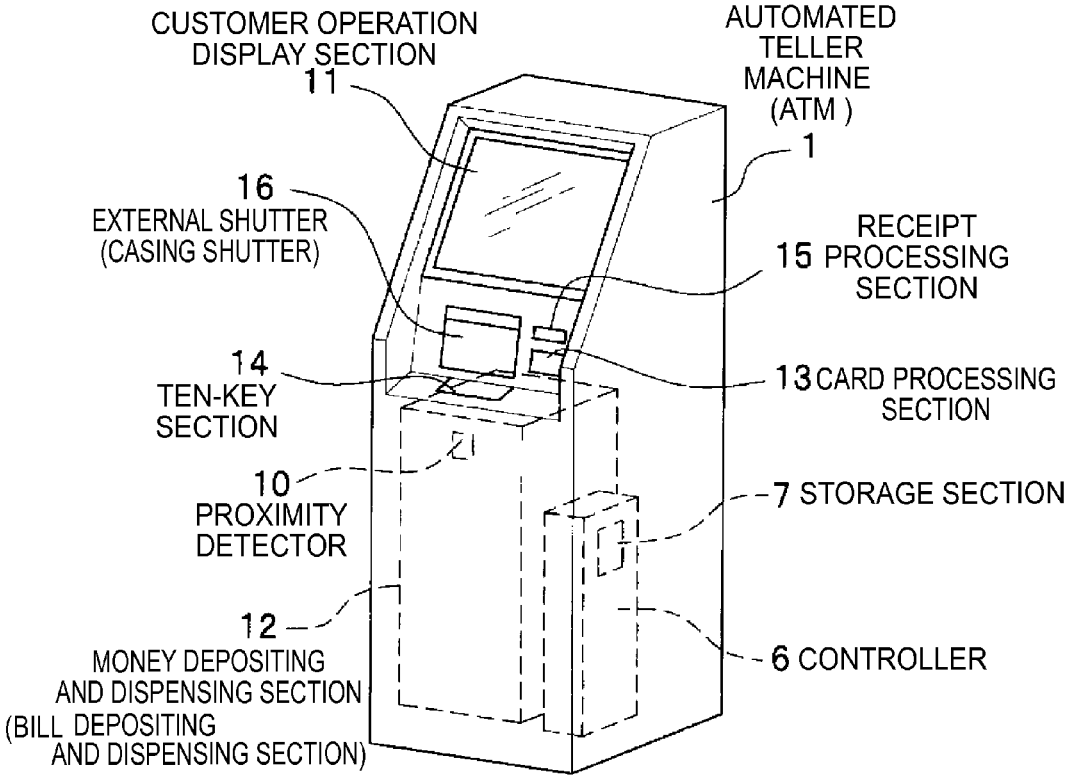
FIG. 1 is a diagram (1) showing an overall configuration of a medium processing apparatus according to an exemplary embodiment.

Detailed explanation follows below regarding an exemplary embodiment of the present invention, with reference to the drawings. Each of the drawings is merely an outline representation at a sufficient level to enable understanding of the present invention. Consequently, the present invention is not limited only to the examples shown in the drawings. Common configuration elements and similar configuration elements are allocated the same reference numerals in each of the drawings, and duplicated explanation thereof is omitted.

Note that a large number of components are required in bill raising means described in Patent Document 1 and Patent Document 2 (referred to below as "conventional bill raising means") in order to realize an operation sandwiching bills and an operation raising the bills in the sandwiched state. Consequently, there is an increased number of configuration components in the conventional bill, raising means, impeding cost reduction.

Furthermore, in the conventional bill raising means, when performing forgotten bill processing, in order to lower the bills from the raised state of the bills, control is required to switch of the rotation direction of the drive motor. Accordingly, the conventional bill raising means cannot achieve a smooth bill lowering operation.

Hence, the present invention (1) reduces the number of configuration components from those of conventional bill raising means, realizing a reduction in cost, and also (2) enables bill raising operation and lowering operation without switching over the rotation direction of the drive motor, simplifying rotation control of the drive motor and having a supplementary object of providing a handover mechanism for realization of a smooth bill lowering operation.

Overall Configuration of Medium Processing Apparatus (Automated Teller Machine)

Figure 2:
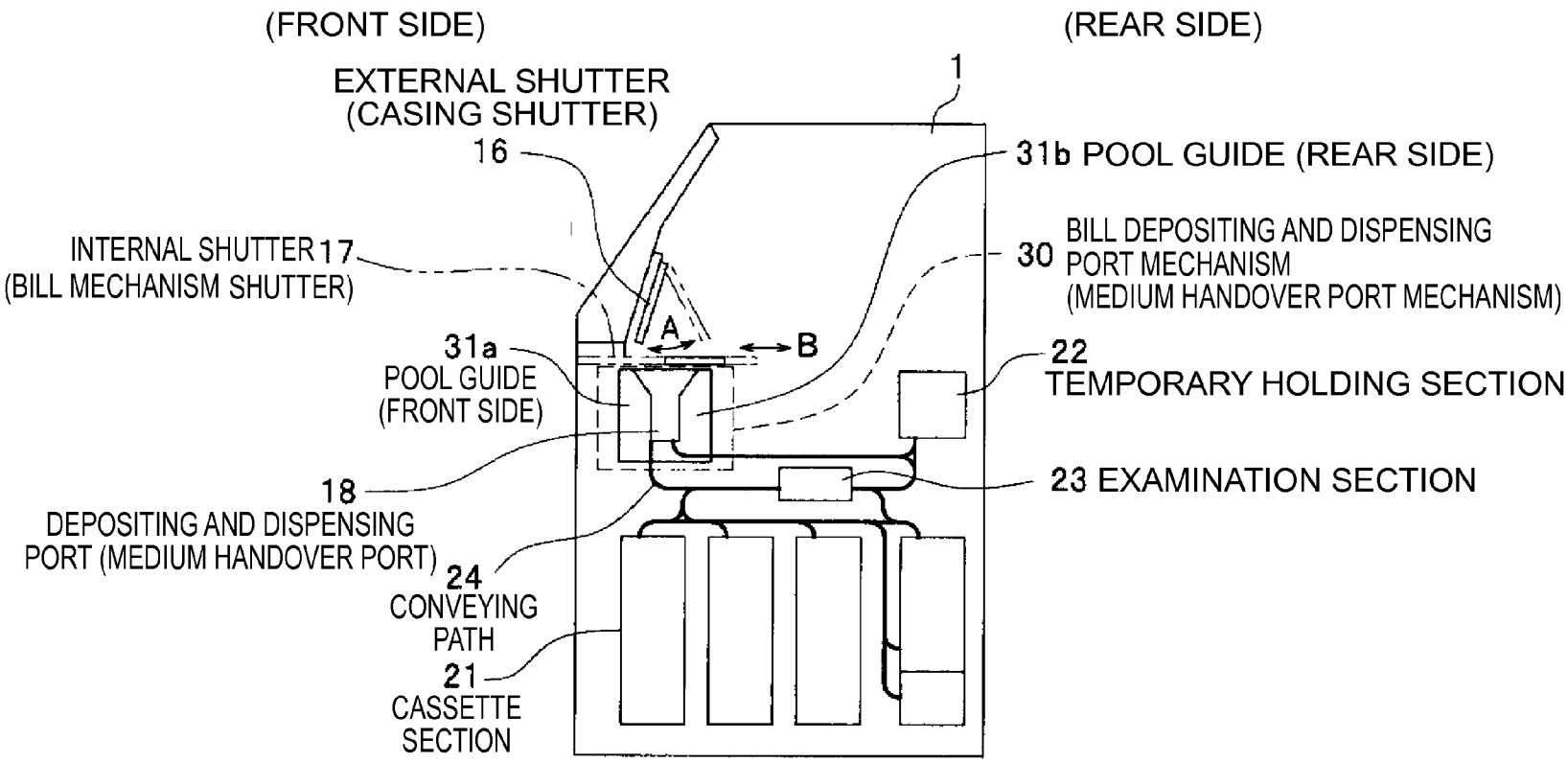
FIG. 2 is a diagram (2) showing an overall configuration of a medium processing apparatus according to an exemplary embodiment.

Explanation follows below regarding an overall configuration of a medium processing apparatus according to the present exemplary embodiment, with reference to FIG. 1 and FIG. 2. FIG. 1 and FIG. 2 are drawings respectively illustrating an overall configuration of a medium processing apparatus according to an exemplary embodiment. FIG. 1 illustrates the external configuration of the medium processing apparatus according to the present exemplary embodiment, and FIG. 2 illustrates the main internal configuration of the medium processing apparatus. Explanation is given here in which an ATM is employed as the medium processing apparatus, bills (dispensing bills) are employed as the paper medium, and a bill depositing and dispensing port mechanism is employed as the medium handover port mechanism.

An ATM 1 is installed in a branch of a financial institution, a convenience store, a gasoline stand, a supermarket or the like and is a machine for depositing and dispensing bills as the paper medium. The ATM 1 is connected via a communication line to a host computer, not shown in the drawings, maintained and controlled by a financial institution. The host computer has customer data stored on a storage device, not shown in the drawings, such as user account numbers and names, residual saving balance data and the like.

As shown in FIG. 1, the ATM 1 includes a controller 6, a storage section 7, a proximity detector 10, a customer operation display section 11, a money depositing and dispensing section 12, a card processing section 13, a ten-key section 14, a receipt processing section 15, and a casing shutter 16.

As shown in FIG. 2, the ATM 1 also includes a bill mechanism shutter 17, a depositing and dispensing port 18, a cassette section 21, a temporary holding section 22, an examination section 23, a conveying path 24, a bill depositing and dispensing port mechanism 30, and pool guides 31*a*, 31*b*.

The controller 6 is control means for controlling the operation of each of the sections of the ATM 1. The controller 6 is configured by a CPU. The controller 6 has an interface section that acts as a connection port with a host computer.

The storage section 7 is storage means for storing various control programs and data. The storage section 7 is configured by RAM and a ROM, hard disk or the like.

The proximity detector 10 is detection means for detecting a user approaching the ATM 1.

The customer operation display section 11 displays various information related to transaction processing, and is a configuration element by which operation data is input by a user. The customer operation display section 11 is equipped with a transaction guidance display section for providing a customer with various information related to transaction processing, and a touch panel disposed on the surface of the transaction guidance display section for operation data to be input by a customer.

The money depositing and dispensing section 12 is a configuration element for handling money. Explanation here is of a case in which the money is bills M, serving as the paper medium. The money depositing and dispensing section 12 is referred to below as the "bill depositing and dispensing section 12".

The card processing section 13 is reading means for reading a code set for each financial institution and customer data, such as customer account number, name and the like, from a customer identification card (cashing card or the like). The card processing section 13 is disposed inside of a card insertion and return opening provided on the front side of the ATM 1.

When a customer inserts a cashing card into the card insertion and return opening, the ATM 1 draws the cashing card inside and reads customer data with the card processing section 13. When a transaction has been completed, the ATM 1 returns the cashing card to the card insertion and return opening, for return to the customer.

The ten-key section 14 is input means for inputting a PIN number and the like. The customer inputs the PIN number by operating the ten-key section 14 according to instructions on a transaction progress screen displayed on the customer operation display section 11. The ten-key section 14 may be provided to the customer operation display section 11. When the customer operation display section 11 is provided at a inclined angle, as shown in FIG. 1, the ten-key section 14 is preferably provided substantially horizontally in a position obscured by the body of the customer so that input operation of PIN numbers and the like by the customer can be prevented from being seen by a third party standing behind the customer.

The receipt processing section 15 is printing means for printing a transaction receipt slip.

The casing shutter 16 and the bill mechanism shutter 17 are shutters respectively provided at the periphery of the depositing and dispensing port 18. The casino shutter 16 is a shutter provided to the casing, and the bill mechanism shutter 17 is a shutter provided within the casing. The casing shutter 16 is referred to below as the "external shutter" and the bill mechanism shutter 17 is referred to below as the "internal shutter 17".

The external shutter 16 is for protecting the internal shutter 17. The external shutter 16 is opened and closed by being swung in the arrow A direction shown in FIG. 2, by a motor or the like, not shown in the drawings. There is a sensor, not shown in the drawings, disposed at the periphery of the external shutter 16 for detecting the open-closed position of the external shutter 16. The controller 6 controls opening and closing operation of the external shutter 16 according to detection data from the sensor.

The internal shutter 17 restricts introduction by a customer of bills M for depositing processing (referred to below as "depositing bills M") in the depositing and dispensing port 18, and removing of bills M for dispensing processing (referred to below as "dispensing bills M" from the depositing and dispensing port 18. The internal shutter 17 opens and closes by being slid in the arrow B direction shown in FIG. 2 by a motor, not shown in the drawings. A sensor, not shown in the drawings, is disposed at the periphery of the internal shutter 17 for detecting the open-closed position of the internal, shutter 17. The controller 6 controls the opening and closing operation of the internal shutter 17 according to sensor data from this sensor.

The depositing and dispensing port 18 is a medium handover port employed or handing over the paper medium to and from a customer. The depositing and dispensing port 18 is provided at an inclined angle such that the user side (the ATM 1 front side thereof) is lower, and the ATM 1 rear side thereof is higher.

During a depositing transaction, the depositing and dispensing port 18 adopts a state enabling introduction of the depositing bills M by the external shutter 16 and the internal shutter 17 adopting an open state. When a customer has introduced depositing bills M into the depositing and dispensing port 18, the ATM 1 draws the depositing bills M into the bill depositing and dispensing section 12.

The dispensing bills M are collected in the depositing and dispensing port 18 during a dispensing transaction or the like, and, by the external shutter 16 and the internal shutter 17 adopting an open state, the depositing and dispensing port 18 adopts a state enabling the dispensing bills M to be removed. Note that in the ATM 1, in instances where the dispensing bills M have not be removed from the depositing and dispensing port 18 after a specific period of time or greater, the bill depositing and dispensing port mechanism 30 successively performs an operation to raise the dispensing bills M so that they are externally exposed from the depositing and dispensing port 18, and an operation to lower the dispensing bills M to house the dispensing bills M inside the depositing and dispensing port 18.

Accordingly, the ATM 1 uses a visible action to notify a user of the position of the dispensing bills M, and to also prompt the user to remove the dispensing bills M.

The cassette section 21 is a holding store for holding the bills M separately by denomination.

The temporary holding section 22 is a holding store for temporarily holding the bills M during depositing and dispensing transactions.

The examination section 23 is a configuration element for performing authenticity examination and counting of the bills M during depositing and dispensing transactions.

The conveying path 24 is conveying means for conveying the bills M to each of the sections.

The bill depositing and dispensing port mechanism 30 is a mechanism for lifting up the paper medium inside the medium handover port (in this case the depositing and dispensing port 18). In the present exemplary embodiment, the bill depositing and dispensing port mechanism 30 successively raises and lowers the dispensing bills M inside the depositing and dispensing port 18 during a dispensing transaction.

The pool guides 31*a*, 31*b* are respective guide members provided exposed at the inside of the depositing and dispensing port 18 for supporting the paper medium. The pool guide 31*a* is provided on the ATM 1 front side, and the pool guide 31*b* is provided at the ATM 1 rear side.

Configuration of the Medium Handover Port Mechanism (Bill Depositing and Dispensing Port Mechanism)

Figure 3:
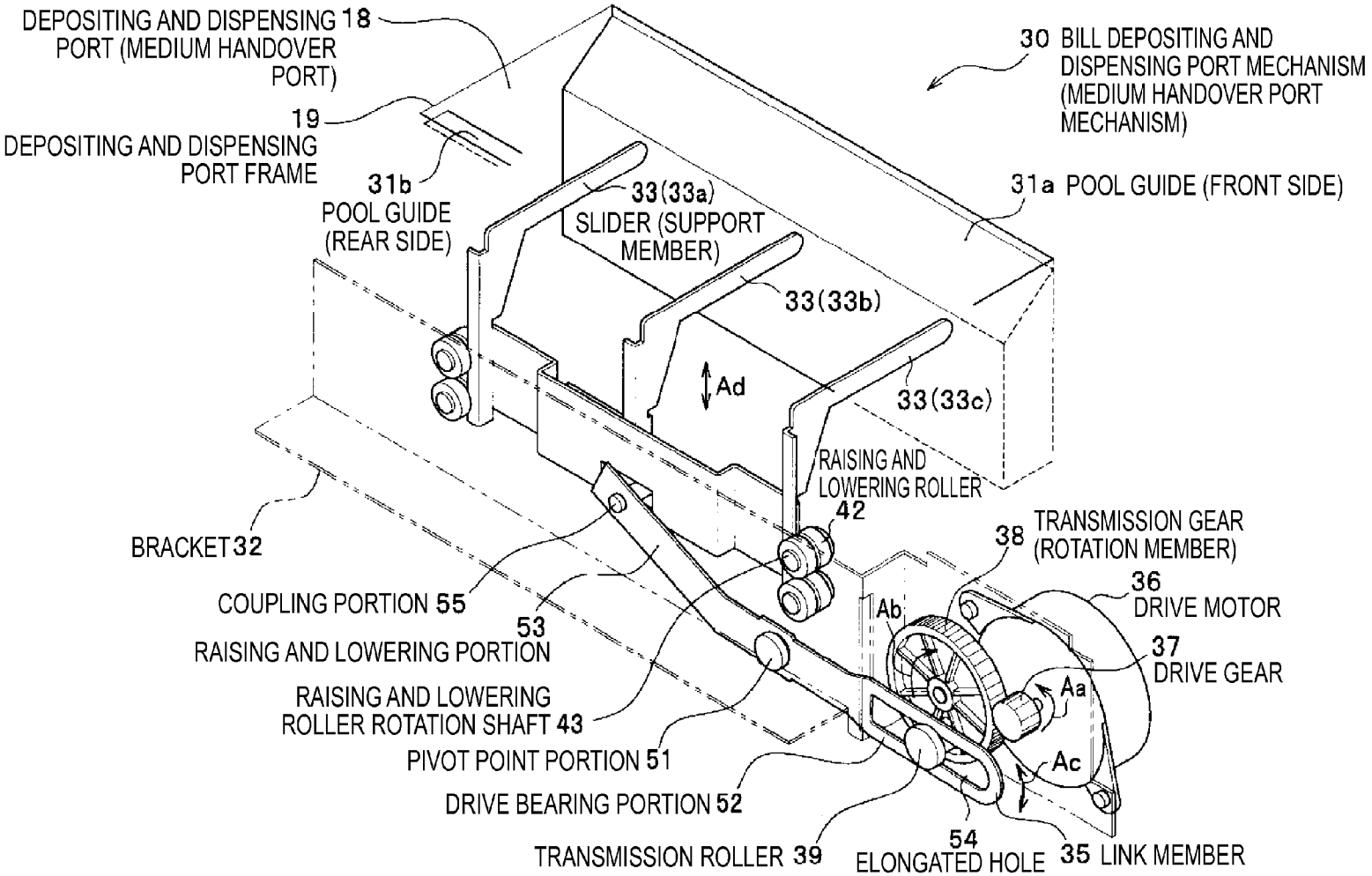
FIG. 3 is a diagram (1) showing a configuration of a medium handover port mechanism of a medium processing apparatus according to an exemplary embodiment.
Figure 4:
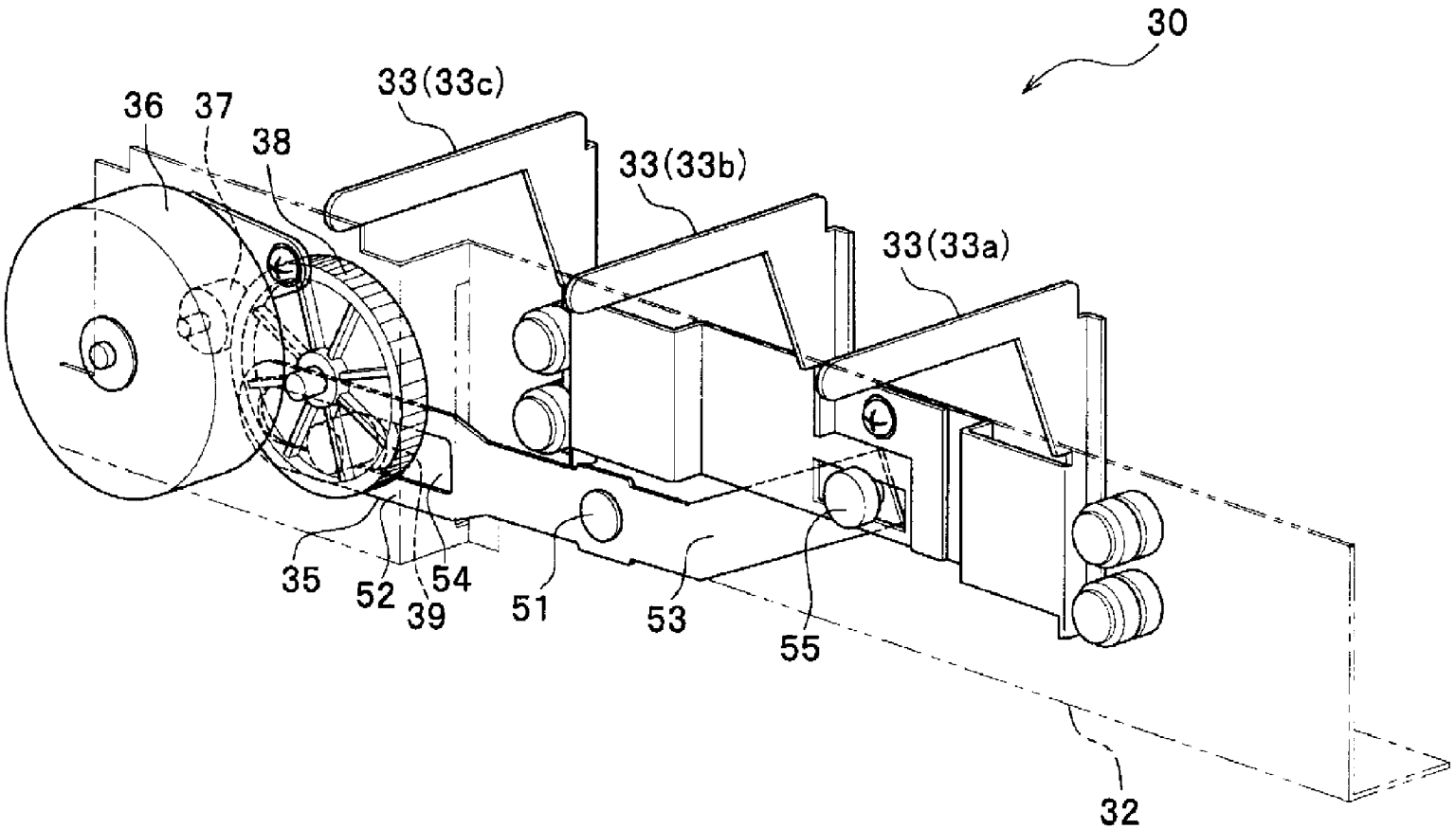
FIG. 4 is a diagram (2) showing a configuration of a medium transaction port mechanism of a medium processing apparatus according to an exemplary embodiment.
Figure 5:
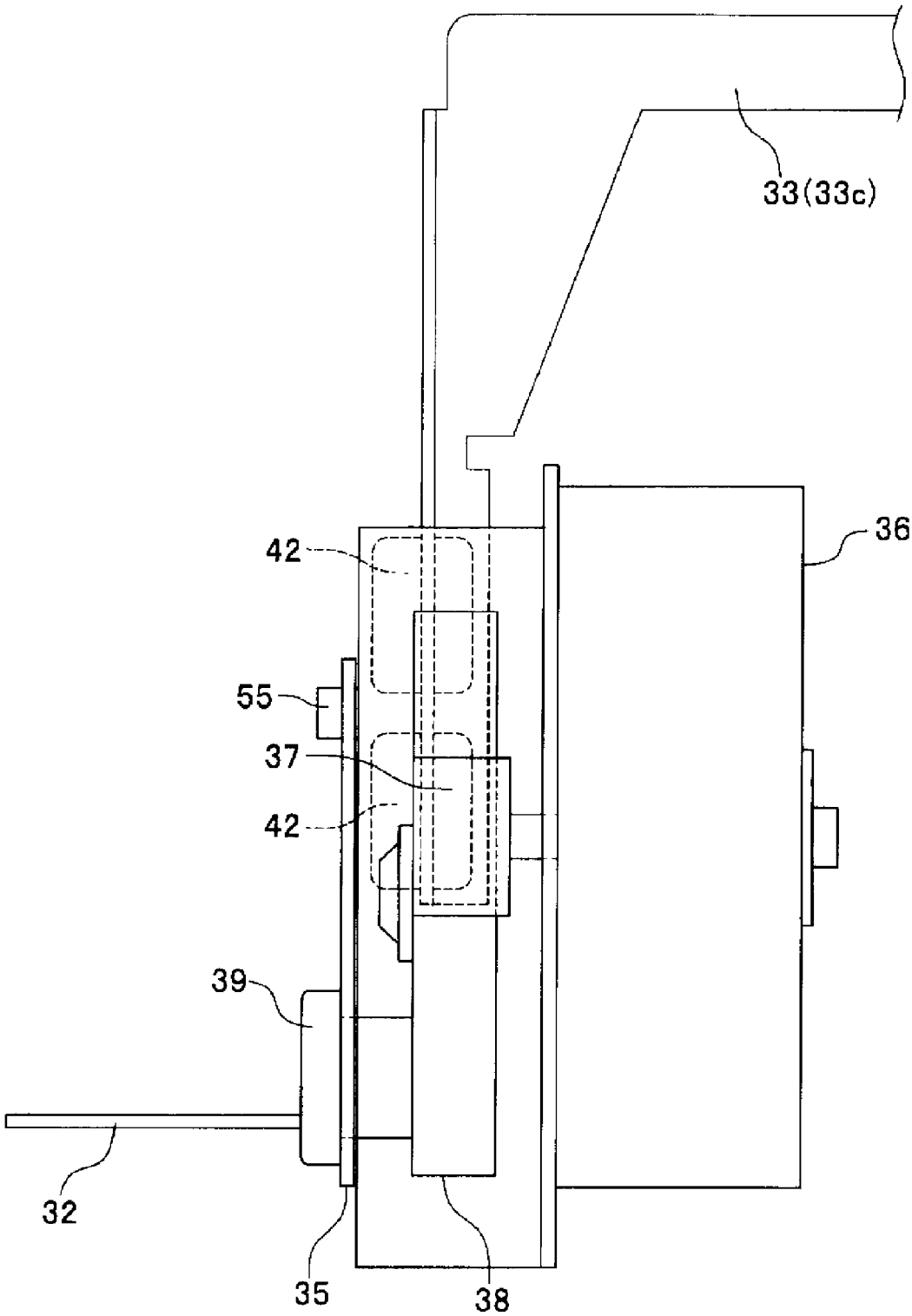
FIG. 5 is a diagram (3) showing a configuration of a medium transaction port mechanism of a medium processing apparatus according to an exemplary embodiment.

Explanation follows regarding a configuration of the medium handover port mechanism according to the present exemplary embodiment, with reference to FIG. 3 to FIG. 5. FIG. 3 illustrates a configuration of the medium handover port mechanism as viewed from the rear side. FIG. 4 illustrates the configuration of the medium handover port mechanism as viewed from the front side. FIG. 5 illustrates the configuration of the medium handover port mechanism as viewed from the side. Note that in the present exemplary embodiment the bill depositing and dispensing port mechanism 30 is, similarly to the depositing and dispensing port 18, provided at an inclined angle, such that the user side (the front side) thereof is lower and the ATM 1 rear side thereof is higher.

As shown in FIG. 3 to FIG. 5, the bill depositing and dispensing port mechanism 30 includes a bracket 32, a slider 33, a link member 35, a drive motor 36, a drive gear 37, and a transmission gear 38.

The bracket 32 is a support member for supporting each member, such as the link member 35, the drive motor 36, the transmission gear 38 and the like. The link member 35 is attached to the bracket 32 such that the link member 35 pivots about a pivot point portion 51, described later.

A first end side of the link member 35 is coupled to the slider 33 by a coupling portion 55, described later, and the other end side of the link member 35 is coupled to a rotation member (in this case the transmission gear 38) by a drive bearing portion 52, described later. The drive motor 36 is attached to the bracket 32 such that the drive gear 37 attached to the rotation shaft of the drive motor 36 meshes with the transmission gear 38. The transmission gear 38 is attached to the bracket 32 such that the transmission gear 38 rotates in a parallel state to the drive hearing portion 52, described, later, of the link member 35.

Note that in the example illustrated in FIG. 3 to FIG. 5, the bracket 32 is formed in a shape such that the portion of the bracket 32 positioned at the periphery of the slider 33 is displaced backwards to the rear side (see FIG. 2), and the portion of the bracket 32 positioned at the periphery of the drive motor 36, the drive gear 37, and the transmission gear 38 projects out to the front side (see FIG. 2).

The portion formed projecting out is referred to below as the "projecting portion", and the portion formed displaced backwards is referred to as the "rearward portion", with the portion connecting together the projecting portion and the rearward portion referred to as the "side portion". An opening is provided in the side portion of the bracket 32 for the link member 35 to pass through.

The link member 35 is attached at the front side of the rearward portion of the bracket 32 with the pivot point portion 51, described later. The link member 35 is disposed passing through from the front side to the rear side of the bracket 32 due to the link member 35 passing through the opening provided in the side portion of the bracket 32.

The drive motor 36, the drive gear 37 and the transmission gear 38 are attached at the rear side of the projecting portion of the bracket 32. Driving force from the drive motor 36 is transmitted to the link member 35 by the link member 35 engaging the transmission gear 38 with the drive bearing portion 52, described later.

The slider 33 is a support member for supporting the paper medium. The slider 33 is connected to the drive motor 36 through the link member 35, the transmission gear 38 and the drive gear 37. The slider 33 successively moves with she paper medium being placed thereon up and down inside the medium handover port by the rotation shaft of the drive motor 36 rotating in one direction (direction Aa shown in FIG. 3).

In the present exemplary embodiment, the slider 33 is configured equipped with three locations (referred to below as "support portions") 33*a*, 33*b*, 33*c* for supporting the bills M. The slider 33 is configured using two sheet metal plates. The right hand side support portion 33*a* and the left hand side support portion 33*c* are formed by bending and folding the first sheet metal plate. The central support portion 33*b* is formed by bending and folding the second sheet metal plate. The slider 33 is then formed by attaching the second sheet metal plate at substantially the center of the first sheet metal plate.

However, configuration may be made such that, for example, the support member 33 is configured by integrally forming the support portions 33*a*, 33*b*, 33*c*, for example by casting. The slider 33 may also be configured by a synthetic resin, such as a plastic or the like, as long as sufficient strength can be secured.

Figure 6:
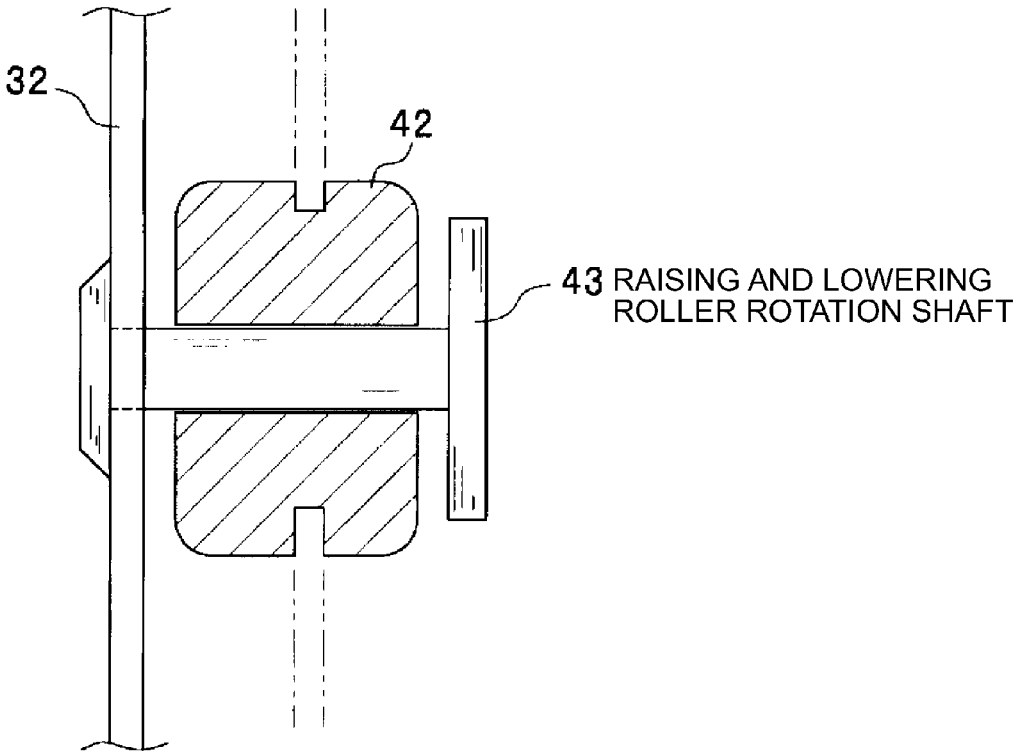
FIG. 6 is a diagram (4) showing a configuration of a medium transaction port mechanism of a medium processing apparatus according to an exemplary embodiment.

Raising and lowering rollers 42 are provided at both flanks of the slider 33. The raising and lowering rollers 42 are members for smoothing raising and lowering motions performed by the slider 33. The raising and lowering rollers 42 make contact with two rails (slider shafts), not shown in the drawings, provided along the top-bottom direction at the periphery of the slider 33. The slider 33 slides in the top-bottom direction along the two rails by the raising and lowering rollers 42 rotating over the surface of the two rails. Furthermore, the raising and lowering rollers 42 may be configured, as shown in FIG. 6, with a configuration in which the raising and lowering rollers 42 are fixed, rotatably, to the bracket 32 by raising and dowering roller rotation shafts 43 alone. FIG. 6 is an enlarged cross-section of one of the raising and lowering rollers 42. The thus configured raising and lowering rollers 42 smooth the raising and lowering motions of the slider 33 by rotating during raising and lowering motions of the slider 33.

The link member 35 is a long plate shaped member, connected at a first end side so the slider 33, and provided extending along a different direction at the first end side and at the other end side. The link member 35 is configured with a raising and lowering portion 53 at the first end side for raising and lowering the slider 33, and the drive bearing portion 52 at the other end side for taking driving force from the drive motor 36.

The link member 35 is equipped at the raising and dowering portion 53 with the coupling portion 55 rotatably connected to the slider 33. The link member 35 is also provided with an elongated hole 54 in the drive bearing portion 52 for slidably supporting a transmission roller 39, described later, of the transmission gear 38.

The elongated hole 54 is formed elongated along the extending direction of the drive bearing portion 52, so as to encompass the moving range of the transmission roller 39. A substantially central portion of the link member 35 is provided with the pivot point portion 51 than is rotatably connected to the bracket 32, and the drive bearing portion 52 and the raising and lowering portion 53 perform raising and lowering motions by pivoting about the pivot point portion 51. The link member 35 is preferably configured by a metal plate in order to secure sufficient strength.

The drive motor 36 is drive means for rotationally driving the transmission gear 38.

The drive gear 37 is a gear for meshing with the transmission gear 38, and is attached to the rotation shaft of the drive motor 36.

The transmission gear 38 is a rotation member that rotates parallel to the drive bearing portion 52 of the link member 35. The transmission gear 38 rotates due to receipt of driving force from the drive motor 36 through the drive gear 37.

A peripheral edge portion of the transmission gear 38 is equipped with a transmission roller 39. The transmission roller 39 is a protruding portion that protrudes out towards the drive bearing portion 52 of the link member 35. The transmission gear 38 engages with the drive bearing portion 52 of the link member 35 due to insertion of the transmission roller 39 into the elongated hole 54 of the drive bearing portion 52 of the link member 35. Accordingly, the transmission gear 38 transmits driving force from the drive motor 36 to the link member 35. Note that she transmission gear 38 may be attached to the rotation shaft of the drive motor 36. In such a case, a configuration is adopted in which the transmission gear 38 rotates on direct receipt of driving for from the drive motor 36, rather than through the drive gear 37.

Operation of the Medium Handover Port Mechanism (Bill Depositing and Dispensing Port Mechanism)

Explanation now follows regarding operation of the medium handover port mechanism. An explanation is first given of overall operation of the bill depositing and dispensing port mechanism 30, then explanation is given of a specific operation of the bill depositing and dispensing port mechanism 30.

Overall Operation of the Bill Depositing and Dispensing Port Mechanism

An explanation follows first of overall operation of the bill depositing and dispensing port mechanism 30.

First, the controller 6 of the ATM 1 actuates the drive motor 36 of the bill depositing and dispensing port mechanism 30, and thereby rotating the rotation shaft of the drive motor 36 in one direction (direction Aa shown in FIG. 3).

The drive gear 37 meshed with the transmission gear 38 is attached to the rotation shaft of the drive motor 36. Accordingly, the transmission gear 38 rotates in the opposite direction to that of the rotation shaft of the drive motor 36 (direction Ab shown in FIG. 3).

The transmission roller 39 is provided at the peripheral edge portion of the transmission gear 38, and the transmission roller 39 is inserted into the elongated hole 54 of the drive bearing portion 52 of the link member 35. Accordingly, the transmission roller 39 slides inside the elongated hole 54, accompanying the rotation of the transmission gear 38 in the opposite direction to that of the rotation shaft of the drive motor 36 (direction Ab shown in FIG. 3).

Accompanying sliding of the transmission roller 39 inside the elongated hole 54, the link member 35 pivots about the pivot point portion 51 such that the drive bearing portion 52 raises and lowers in direction Ac shown in FIG. 3, and the raising and lowering portion 53 raises and lowers in the opposite direction to the direction of motion of the drive bearing portion 52.

As a result, the slider 33 connected to the coupling portion 55 of the raising and lowering portion 53 of the link member 35 raises and lowers in direction Ad shown in FIG. 3.

Accordingly, the bill depositing and dispensing port mechanism 30 successively raises and lowers the slider 33 and the bills M placed on the slider 33 by rotating the drive motor 36 in one direction (direction Aa shown in FIG. 3).

The bill depositing and dispensing port mechanism 30 is not equipped with a mechanism and/or belt, roller or the like for gripping the bills M. Consequently, the bills M are lifted up in an unrestrained state (namely, in a free state, not restrained by any member).

Specific Operation of the Bill Depositing and Dispensing Port Mechanism

Explanation now follows regarding a specific operation of the bill depositing and dispensing port mechanism 30 (operation during a dispensing transaction), with reference to FIG. 7 to FIG. 9. FIG. 7 to FIG. 9 are respective diagrams illustrating operation of the medium handover port mechanism according to the present exemplary embodiment. FIG. 7 show the operation of the medium handover port mechanism as seen from the rear side.

Figure 7A:
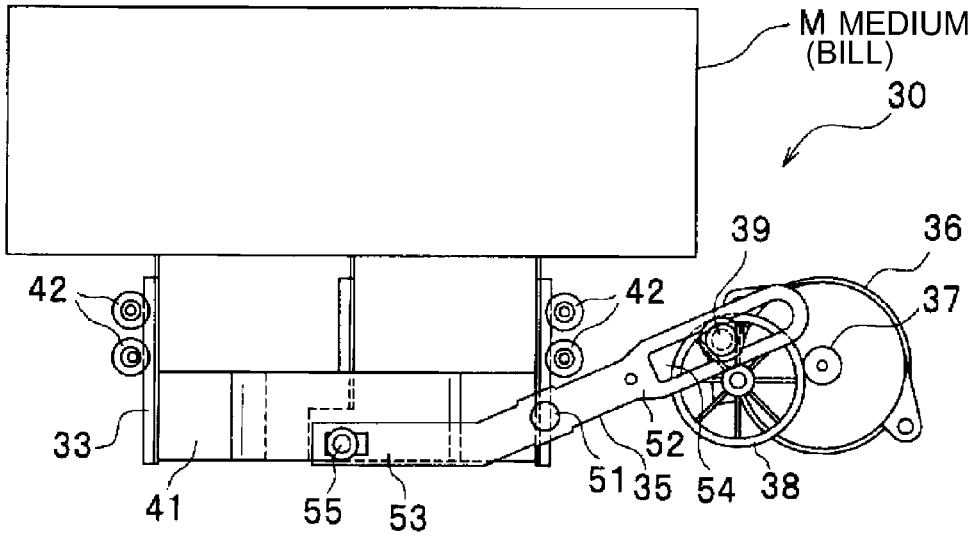
FIG. 7A is a diagram (1) illustrating operation of a medium handover port mechanism of a medium processing apparatus according to an exemplary embodiment.
Figure 7B:
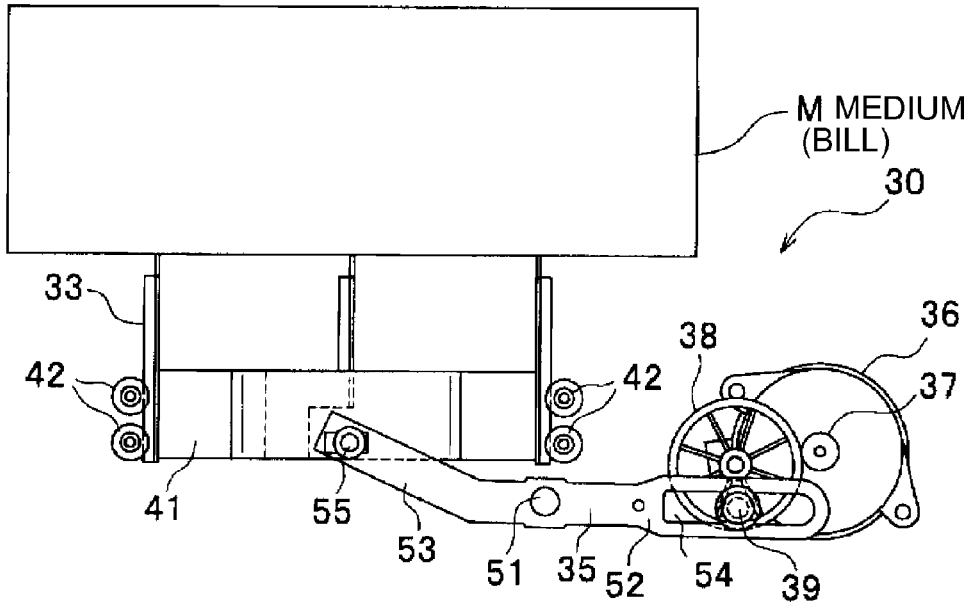
FIG. 7B is a diagram (1) illustrating operation of a medium handover port mechanism of a medium processing apparatus according to an exemplary embodiment.
Figure 8A:
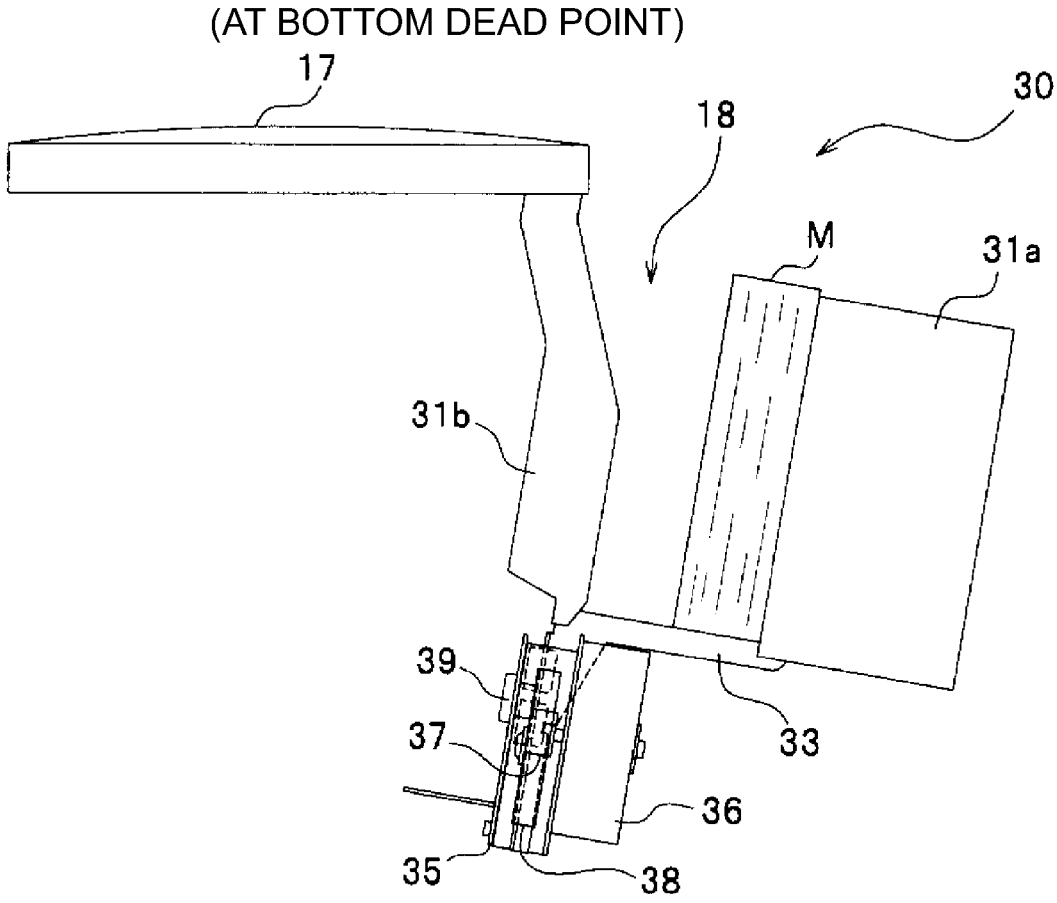
FIG. 8A is a diagram (2) illustrating operation of a medium handover port mechanism of a medium processing apparatus according to an exemplary embodiment.
Figure 8B:
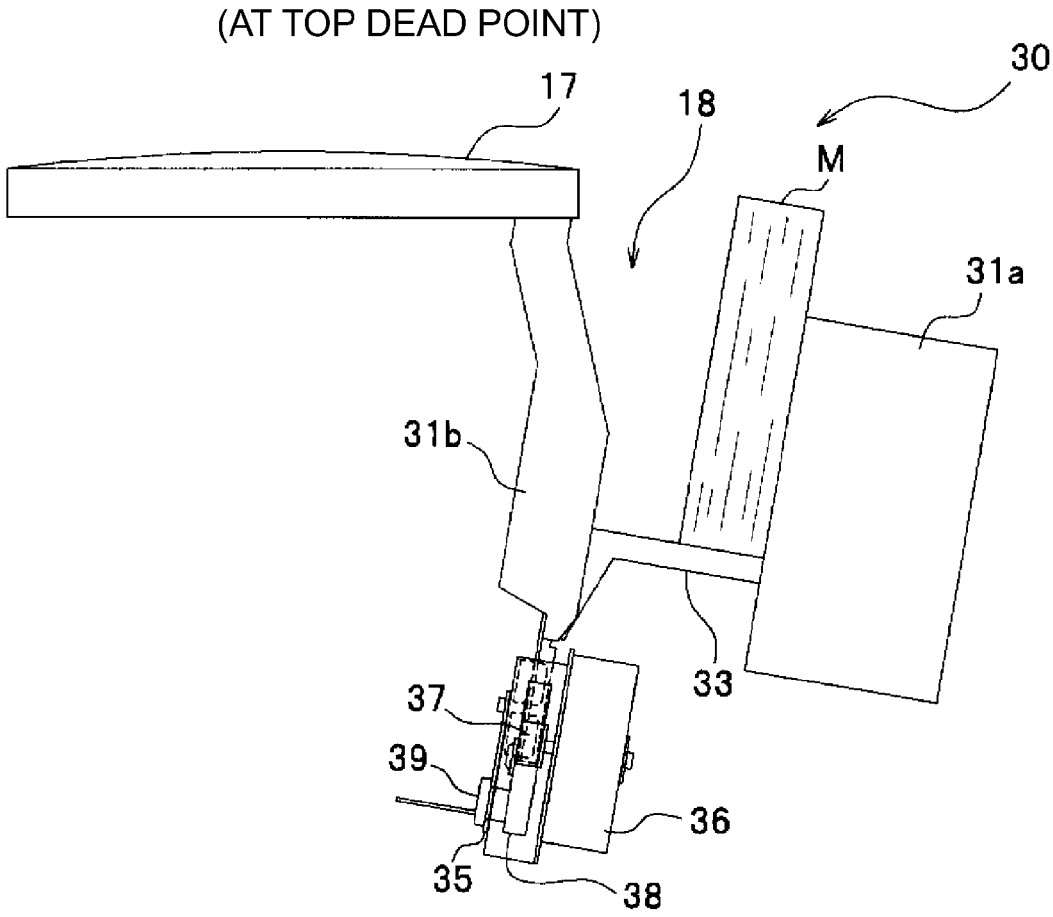
FIG. 8B is a diagram (2) illustrating operation of a medium handover port mechanism of a medium processing apparatus according to an exemplary embodiment.
Figure 9A:
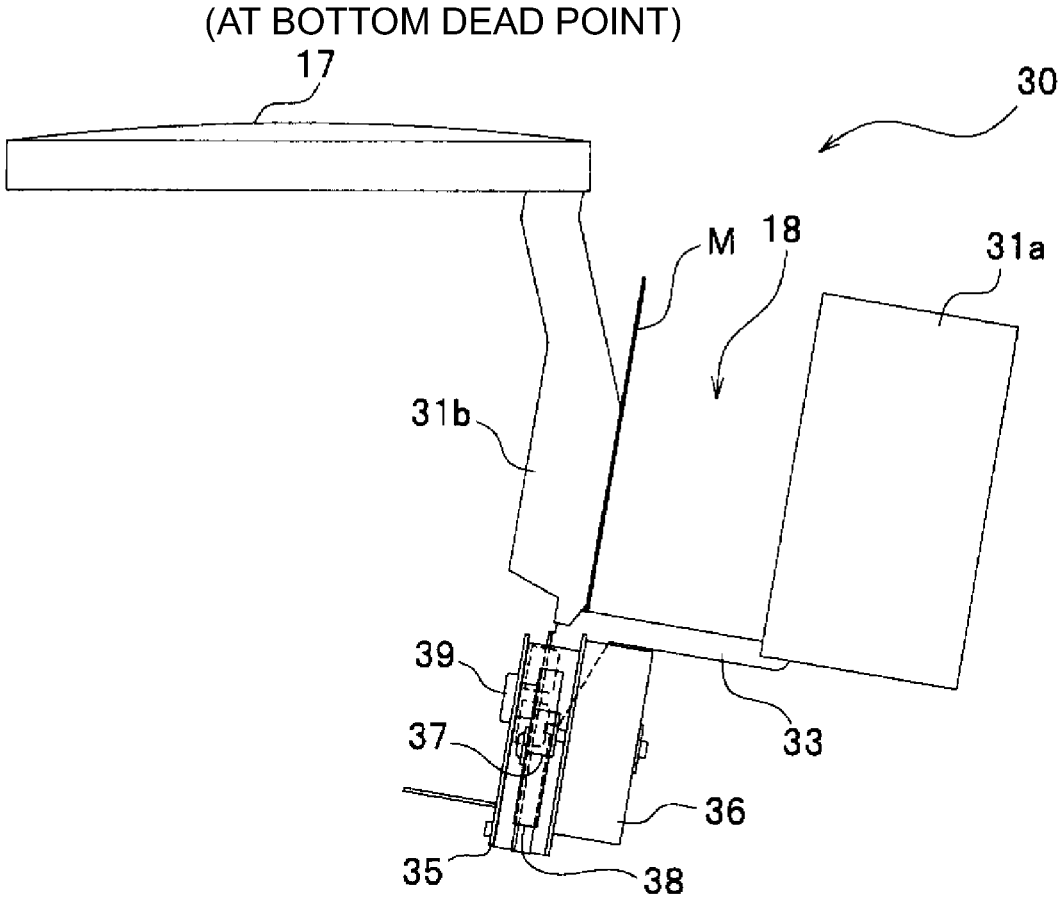
FIG. 9A is a diagram (3) illustrating operation of a medium handover port mechanism of a medium processing apparatus according to an exemplary embodiment.
Figure 9B:
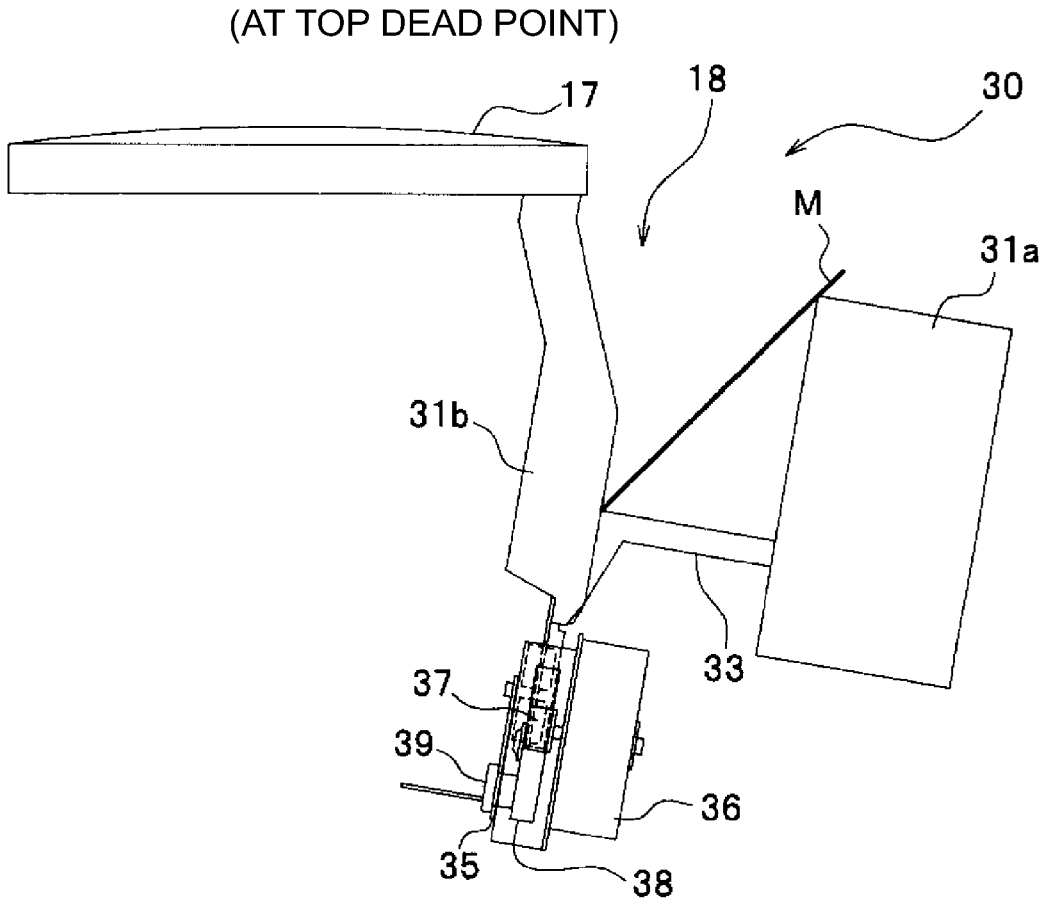
FIG. 9B is a diagram (3) illustrating operation of a medium handover port mechanism of a medium processing apparatus according to an exemplary embodiment.

FIG. 7A shows the slider 33 in a state when positioned at the bottom dead point and FIG. 7B shows the slider 33 in a state when positioned at the top dead point. FIG. 8 and FIG. 9 show operation of the medium handover port mechanism as seen from the side. FIG. 8 shows operation when dispensing comparatively lots of bills M and FIG. 9 shows operation when dispensing comparatively few bills M (a single bill in the illustrated example). FIG. 8A and FIG. 9A show the slider 33 in a state when positioned at the bottom dead point and FIG. 8B and FIG. 9B show the slider 33 in a state when positioned at she sop dead point.

The bill depositing and dispensing port mechanism 30 pre-disposes the slider 33 at the bottom dead point, as shown in FIG. 7A and FIG. 8A. Note that positional control of the slider 33 here is, for example, performed by the controller 6 based on output of a position detection sensor, not shown in the drawings, for detecting the position of the transmission roller 39. When the transmission roller 39 is in the state shown in FIG. 7A, the controller 6 determines that the slider 33 is positioned at the bottom dead point, and when the transmission roller 39 is in the state shown in FIG. 7B, the controller 6 determines that the slider 33 is positioned at the top dead point. The controller 6 preferably monitors the rotation angles of the transmission gear 38 and the drive motor 36, and controls rotation of the drive motor 36 such that the slider 33 is stopped at the bottom dead point or the top dead point.

The ATM 1 starts a dispensing transaction when instructed to perform a dispensing transaction as the transaction processing by a customer, such as through operation of the customer operation display section 11, and when the withdrawal amount has also been input. At this stage, the controller 6 of the ATM 1 actuates the bill depositing and dispensing section 12, and causes the bills M stored in the cassette section 21 to be examined by the examination section 23. The controller 6 also collects the bills M determined by the examination section 23 to be dispensable, collecting the number of bills corresponding to the withdrawal amount above the slider 33 inside the depositing and dispensing port 18.

When the bills M have been collected on the slider 33, the controller 6 starts opening of the external shutter 16 and the internal shutter 17 provided at the periphery of the depositing and dispensing port 18.

The controller 6 actuates the drive motor 36 of the bill depositing and dispensing port mechanism 30, rotating the rotation shaft of the drive motor 36 in one direction (direction Aa shown in FIG. 3). The controller 6 thereby raises the slider 33 and the bills M placed on the slider 33. When the slider 33 has been raised up and positioned at the top dead point (see FIG. 7B and FIG. 8B), the controller 6 temporarily stops the drive motor 36. The controller 6 then monitors the state of removal of the bills from the output of a bill detection sensor, not shown in the drawings, provided inside the depositing and dispensing port 18.

When detected that the customer has removed the bills M, the controller 6 actuates the drive motor 36, and rotates the rotation shaft of the drive motor 36 in the same direction as when raising the slider 33 (direction Aa shown in FIG. 3). The controller 6 thereby lowers the slider 33. When the slider 33 has been lowered to the position of bottom dead point (see FIG. 7A and FIG. 8A) the controller 6 stops the drive motor 36. The controller 6 then closes the external shutter 16 and the internal, shutter 17 provided at the periphery of the depositing and dispensing port 18. The ATM 1 thereby completes the dispensing processing.

Note that when the time elapsed from opening the external shutter 16 and the internal shutter 17 (referred to below as "elapsed time") has reached a specific duration or longer without the bills M being removed from the depositing and dispensing port 18, the controller 6 causes an alarm sound prompting the user to remove the bills M to be emitted from speakers, not shown in the drawings, provided at the periphery of the depositing and dispensing port 18, up until a predetermined duration for bill removal (referred to below as the "bill removal duration") has elapsed.

When this is occurring, the controller 6 also actuates the drive motor 36 to rotate the rotation shaft of the drive motor 36 in one direction (direction Aa shown in FIG. 3) until the elapsed time has reached the bill removal duration. As a result, in the ATM 1 the bill depositing and dispensing port mechanism 30 successively performs an operation raising the dispensing bills M and externally exposing the dispensing bills M from the depositing and dispensing port 18, and an operation lowering the dispensing bills M and housing the dispensing bills M inside the depositing and dispensing port 18. Accordingly, when there is a question as to whether or not the bills M have been forgotten, the ATM 1 notifies the user of the position of the dispensing bills M and prompts the user to remove the dispensing bills M using a visible action. Consequently, the ATM 1 can reduce the frequency of occurrences of forgetting to remove the dispensing bills M.

Note that configuration may be made here such that the controller 6 controls to vary the rotation speed of the drive motor 36. Furthermore, the controller 6 may be configured so as to broadcast an announcement prompting removal of the bills M, such as "Please take the bills M" or the like, from speakers, not shown in the drawings, provided at the periphery of the depositing and dispensing port 18.

When the elapsed time has reached the bill removal duration and the bills M have still not been removed, the controller 6 lowers the slider 33 and the bills M placed on the slider 33. When the slider 33 has been positioned at the bottom dead point (see FIG. 7A and FIG. 8A), the controller 6 stops the drive motor 36. The controller 6 then closes the external shutter 16 and the internal shutter 17 provided at the periphery of the depositing and dispensing port 18, the bill depositing and dispensing section 12 stores the bills M placed on the slider 33 in a removal forgotten cassette, not shown in the drawings. The ATM 1 thereby completes dispensing processing.

However, in cases where the user is detected as having walked away by the proximity detector 10 even though the elapsed time has not yet reached the bill, removal duration, were the controller 6 to leave the external shutter 16 and the internal shutter 17 as they are in the open state then there would be a concern that a third party might remove the bills M. Hence, the controller 6 closes the external shutter 16 and the internal shutter 17 quickly, and the bill depositing and dispensing section 12 stores the bills M placed on the slider 33 in the removal forgotten cassette, not shown in the drawings. The ATM 1 thereby completes dispensing processing.

In order for the ATM 1 to successively raise and lower the bills M, the bill depositing and dispensing port mechanism 30 may be continuously driven for a multiple of the drive duration required for one to-and-fro raising and lowering motion. Due to the ATM 1 performing plural cycles of raising and lowering the bills M without interruption, the attention of the customer can be attracted to both the position of bills M and to removing of the bills M when there is a question as to whether or not removing of the bills M has been forgotten.

Since the ATM 1 can attract the attention of the customer to the position of the bills M and to removing the bills M using a visible action, forgetting to remove the bills M can be efficiently prevented.

Furthermore, in the ATM 1, due to the controller 6 controlling so as to vary the rotation speed of the drive motor 36, the raising and lowering motions of the bills M can be gradually speeded up, and the attention attracting effect can be enhanced. Furthermore, in the ATM 1, by broadcasting at the same time an announcement urging removal of the bills M, such as "Please take the bills M" or the like with the speakers, not shown in the drawings, provided at the periphery of the depositing and dispensing port 18, forgetting to remove the bills M can be even more efficiently prevented.

Note that the bill depositing and dispensing port mechanism 30 is provided at an inclined angle so as to be lower at the user side the front side) and higher at the ATM 1 rear side. Accordingly, by raising and lowering the bills M, the bill depositing and dispensing port mechanism 30 can present the bills M in an unrestrained state (namely, in a free state, not restrained by any member) further towards the customer nearside of the apparatus.

Accordingly, for example as shown in FIG. 8A and FIG. 8B, when the bill depositing and dispensing port mechanism is dispensing comparatively lots of the bills M, the bills M are in a state collected at the customer nearside of the apparatus, and the bills M can be dispensed in this state.

However, as shown in FIG. 9A and FIG. 9B, when the bill depositing and dispensing port mechanism 30 is dispensing comparatively few of the bills M (a single bill in the illustrated example), even suppose, for example, the bill (s) M were initially adhered to the inside of the depositing and dispensing port 18 (an in particular as she far side of the apparatus), the bills M are raised and lowered, shaking the bills M. The bills M can thereby be separated from the inside of the depositing and dispensing port 18. As a result, as shown in FIG. 9B, the bill depositing and dispensing port mechanism 30 can achieve a state in which the bills M are tilted over to the customer nearside of the apparatus, and can dispense the bill in such a state.

Consequently, the ATM 1 can dispense the bills M in a state facilitating removal.

As explained above, according to the medium processing apparatus of the present exemplary embodiment, the frequency with which removal of a paper medium is forgotten can be reduced by successively raising and lowering the paper medium.

Furthermore, according to this medium processing apparatus, since the components of conventional bill raising means for realizing an operation to grip bills and an operation to raise bills in a gripped state become unnecessary, the number of configuration components can be reduced compared to in the conventional bill raising means, and cost can be reduced in comparison to the conventional bill raising means.

Furthermore, according to the medium processing apparatus, since there is no discrimination made during rotation control between forward rotation and reverse rotation of the drive motor 36, configuration may be made such that the drive motor 36 is driven in a single direction for a specific duration. Consequently, according to this medium processing apparatus, simple rotation control of the drive motor 36 can be realized, without the need for rotation direction switching, and smooth bills M raising and lowering operations can also be achieved.

Furthermore, according to the medium processing apparatus, when dispensing comparatively lots of the bills M, the bills M adopt a state collected together at the customer nearside of the apparatus, and the bills M can be dispensed in such a state.

Furthermore, according to the medium processing apparatus, when dispensing comparatively few bills M, even suppose the bills M were initially adhered to the inside of the depositing and dispensing port 18 (particularly at the far side of the apparatus), the bills M can be separated from the inside of the depositing and dispensing port 18 by raising and lowering the bills M. Consequently, according so the medium processing apparatus, the bills P can be dispensed in a state facilitating removal.

The present invention is not limited to the above exemplary embodiment, and various changes and modifications can be made within a scope not departing from the spirit of the present invention.

For example, the medium handover port mechanism 30 is not limited to employing bills, and application may be made to any desired device performing handover of a medium to a user, such as a ticket issuing machine or the like.

Furthermore, for example, the shapes of the bracket and the slider 33 are not limited to those of the illustrated example, and appropriated modifications can be adopted.

Furthermore, for example, in she present exemplary embodiment, the slider 33 employs two sheet metal plates, with the right hand side support portion 33*a* and the left hand side support portion 33*c* formed by bending and folding the first sheet metal plate, and the central support portion 33*b* formed by bending and folding the second sheet metal plate. The slider 33 is then formed by attaching the second sheet metal plate substantially at the centre of the first sheet metal plate. However, configuration of the slider 33 may be made with each of the support portions 33*a*, 33*b*, 33*c* integrally formed, for example by casting. Furthermore, configuration may be made with the slider 33 configured from a synthetic resin, such as a plastic or the like.

Furthermore, for example, in the present exemplary embodiment configuration is made such that driving force of the drive motor 36 is transmitted to the rotation member 38 through she drive gear 37 and the transmission gear 38. However, configuration may be made such that the rotation force of the drive motor 36 is transmitted to the rotation member 38 through another gear (s) in addition to the drive gear 37 and the transmission gear 38. Alternatively, configuration may be made such that the rotation member 38 is attached to the rotation shaft of the drive motor 36 and driving force from the drive motor 36 is directly transmitted thereto.

EXPLANATION OF THE REFERENCE NUMERALS

1 medium processing apparatus (automated teller machine, ATM)
6 controller
7 storage section
10 proximity detector
11 customer operation display section
12 money depositing and dispensing section (bill depositing and dispensing section)
13 card processing section
14 ten-key section
15 receipt processing section
16 external shutter (casing shutter)
17 bill internal shutter (bill mechanism shutter)
18 depositing and dispensing port
21 cassette section
22 temporary holding section
23 examination section
24 conveying path
30 bill depositing and dispensing port mechanism
31*a*, 31*b* pool guide
32 bracket
33 (33*a*, 33*b*, 33*c*) slider (support member)
35 link member
36 drive motor
37 drive gear
38 transmission gear (rotation member)
39 transmission roller
42 raising and lowering roller
43 raising and lowering roller rotation shaft
51 pivot point portion
52 drive bearing portion
53 raising and lowering portion
54 elongated hole
55 coupling portion
M medium (bills)

The invention claimed is:

1. A medium processing apparatus for performing handover of a paper medium to a user, the medium processing apparatus comprising:

a medium handover port where the paper medium is handed over to the user; and a medium handover port mechanism, provided at the medium handover port, that raises a same paper medium to be handed over to the user so that the same paper medium is externally exposed from the medium handover port, and lowers the same paper medium so that the same paper medium is housed inside the medium handover port, the medium handover port mechanism successively and alternatingly raising and lowering the same paper medium more than once, prior to the same paper medium being handed over to the user.

2. The medium processing apparatus of claim 1, wherein the medium handover port mechanism raises and lowers the paper medium in an unrestrained and tilted state.

3. The medium processing apparatus of claim 1, further comprising a holding store for holding the paper medium, a conveying path along which the paper medium is conveyed and that connects the medium handover port and the holding store, and a controller for detecting whether an elapsed time has reached a paper medium removal duration, wherein the medium handover port mechanism successively and alternatingly raises and lowers the same paper medium more than once after a specific period of time has elapsed, and until the elapsed time has reached the paper medium removal duration, after the paper medium is conveyed from the holding store into the medium handover port.

4. A medium processing apparatus for performing handover of a paper medium to a user, the medium processing apparatus comprising:

a medium handover port where the medium is handed over; and a medium handover port mechanism, provided at the medium handover port and successively raising and lowering the medium inside the medium handover port, wherein the medium handover port mechanism includes, a support member for moving the medium up and down inside the medium handover port in a state in which the medium is placed on the support member, an elongated link member provided with a first end side connected to the support member and extending in directions different at the first end side and the other end side of the link member, a bracket for supporting the link member rotatably about a pivot point portion at substantially a center portion of the link member, a rotation member with peripheral edge portion engaging with the other end side of the link member and rotating parallel to the other end side of the link member, and a drive motor that rotationally drives the rotation member, wherein a peripheral edge portion of the rotation member is equipped with a projecting portion that projects out towards the other end side of the link member, the first end side of the link member is equipped with a coupling portion for coupling to the support member, and the other end side of the link member is equipped with a drive bearing portion that receives driving force from the drive motor by slidably supporting the projecting portion of the rotation member.

5. The medium processing apparatus of claim 4, wherein the drive bearing portion of the link member is equipped with an elongated hole formed along an extending direction of the other end side of the link member, and the projecting portion of the rotation member is inserted into the elongated hole of the drive bearing portion.

6. The medium processing apparatus of claim 5, wherein the link member pivots about the pivot point portion such that the first end side of the link member coupled to the support member performs successive raising and lowering motion, due to the drive motor rotating in one direction and the projecting portion of the rotation member sliding inside the elongated hole of the link member accompanying rotation of the drive motor.

7. The medium processing apparatus of claim 4, wherein the bracket rotatably supports the rotation member and fixes the position of the drive motor.

8. The medium processing apparatus of claim 4, wherein the drive motor varies the rotation speed of the rotation member during the medium handover port mechanism successively raising and lowering the medium inside the medium handover port.

* * * * *